US008727521B2

(12) United States Patent
Kariya et al.

(10) Patent No.: US 8,727,521 B2
(45) **Date of Patent: *May 20, 2014**

(54) INKJET IMAGE FORMING METHOD

(75) Inventors: Toshihiro Kariya, Kanagawa (JP); Kaoru Tojo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 495 days.

This patent is subject to a terminal disclaimer.

(21) Appl. No.: 13/074,035

(22) Filed: Mar. 29, 2011

(65) Prior Publication Data

US 2011/0242193 A1 Oct. 6, 2011

(30) Foreign Application Priority Data

Mar. 31, 2010 (JP) ..... 2010-082286
Feb. 24, 2011 (JP) ..... 2011-038275

(51) Int. Cl.
*B41J 2/01* (2006.01)

(52) U.S. Cl.
USPC ..... 347/100

(58) Field of Classification Search
USPC ..... 347/100
See application file for complete search history.

(56) References Cited

U.S. PATENT DOCUMENTS

| | | | | |
|---|---|---|---|---|
| 7,033,013 | B2 * | 4/2006 | Koyano et al. | 347/100 |
| 2001/0055052 | A1 | 12/2001 | Mueller et al. | |
| 2002/0009547 | A1 * | 1/2002 | Ito et al. | 427/337 |
| 2002/0027587 | A1 * | 3/2002 | Sugaya et al. | 347/104 |
| 2003/0174195 | A1 * | 9/2003 | Onishi et al. | 347/105 |
| 2008/0134935 | A1 * | 6/2008 | Kunimine et al. | 106/31.85 |

FOREIGN PATENT DOCUMENTS

| | | | |
|---|---|---|---|
| JP | 10-130621 | A | 5/1998 |
| JP | 2000141886 | A | 5/2000 |
| JP | 2003-039645 | A | 2/2003 |

OTHER PUBLICATIONS

Corresponding EPO Official communication.

* cited by examiner

*Primary Examiner* — Laura Martin
(74) *Attorney, Agent, or Firm* — SOLARIS Intellectual Property Group, PLLC

(57) ABSTRACT

There is disclosed an inkjet image forming method. The method includes recording an image on a recording medium by an inkjet method; supplying a liquid including powder particles having a volume-average particle diameter of 1 μm or more to a surface of a heating roller; and applying the powder particles onto the recording medium via the heating roller.

9 Claims, 1 Drawing Sheet

INKJET IMAGE FORMING METHOD

CROSS-REFERENCE TO RELATED APPLICATION

This application is based on and claims priority under 35 USC 119 from Japanese Patent Application Nos. 2010-082286 filed on Mar. 31, 2010, and 2011-038275 filed on Feb. 24, 2011, the disclosures of which are incorporated herein by reference.

BACKGROUND OF THE INVENTION

1. Field of the Invention

The present invention relates to an inkjet image forming method.

2. Description of the Related Art

Printed articles obtained by printing by a commercial printer such as offset printing, are stacked in large numbers at a high speed in a paper ejection section. In this case, the ink (image) printed (recorded) on one printed article is adhered to another stacked printed article, and, if the adhered printed articles are taken apart, a phenomenon (blocking) in which the ink is peeled off from the one printed article and attached to the another printed article occurs. To suppress this blocking, in offset printing, inter-ink adhesion is prevented by, after printing, spraying powder such as starch as a blocking suppression agent and attaching the powder to the surface of the printed article.

However, there are cases in which an excessive amount of the powder is sprayed. An excessive amount of the powder not only adversely affects the printed articles, but also makes a large amount of the powder scatter extensively in the air, thereby intruding into the inside of, for example, a printer, a CTP plate setter, a computer, or a post processing machine. As a result, for example, lowering of operation accuracy and malfunctions are liable to occur, which is not preferable.

Therefore, Japanese Patent Application Laid-Open (JP-A) No. 10-130621 suggests a method in which a small amount of powder is sprayed on the surface of a printed article.

Meanwhile, JP-A No. 2003-39645 discloses a method including a process in which an image is recorded on a recording medium by an inkjet method and a process in which a microcapsule-containing liquid is sprayed on the recorded image and the microcapsule is crushed.

SUMMARY OF THE INVENTION

However, in JP-A No. 10-130621, particularly in the case of employing the method in an inkjet system, if the powder is present in the air even when a small amount of the powder has been sprayed, the powder is attached to the tip of an inkjet nozzle, which easily causes nozzle clogging, and therefore, the powder-spraying method cannot be employed.

JP-A No. 2003-39645 discloses a method for improving, for example, weather resistance and water resistance by spraying the microcapsules onto the image surface and breaking the microcapsules, thereby applying a film of a core substance having a releasing property (for example, carnauba wax) on the surface of the image, and it is difficult to suppress blocking by this method. In addition, the above method in which the film of the core substance having releasing property is applied is specifically disclosed only for the inkjet method.

The present invention aims at providing an image forming method with which the blocking of recording media on which an image has been recorded is suppressed while occurrence of inkjet nozzle clogging is also suppressed, when employing a mode in which a image is recorded on a recording medium by an inkjet method.

According to an aspect of the present invention, an inkjet image forming method is provided. The method includes recording an image on a recording medium by an inkjet method; supplying a liquid including powder particles having a volume-average particle diameter of 1 μm or more to a surface of a heating roller; and applying the powder particles onto the recording medium via the heating roller.

DETAILED DESCRIPTION

Figure 1:
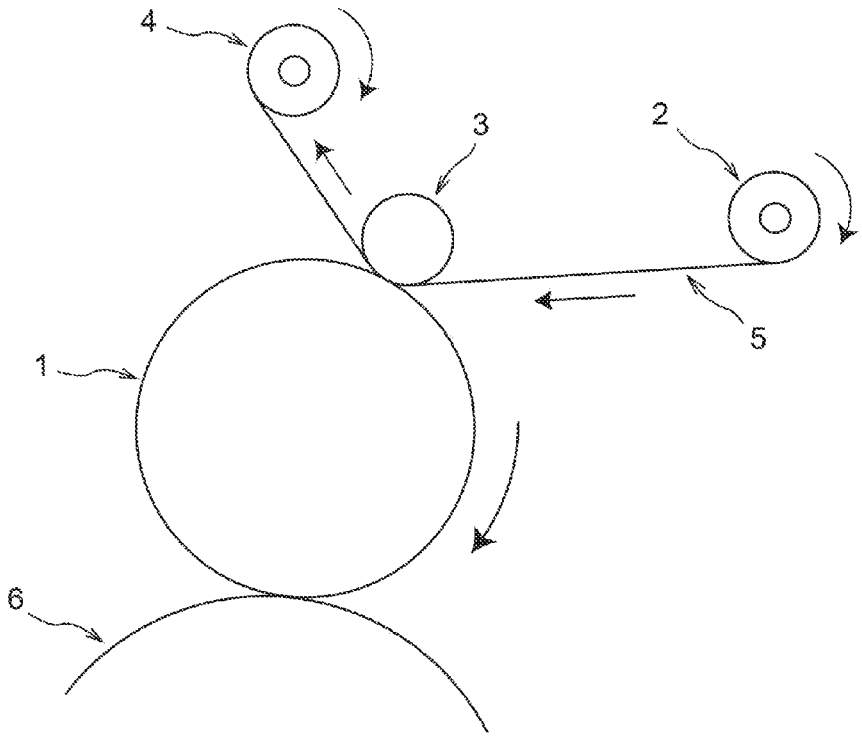
FIG. 1 is a schematic diagram of an apparatus for the application process according to the present invention.

The inkjet image forming method according to the present invention includes recording an image on a recording medium by an inkjet method (recording process); and supplying a liquid including powder particles to the surface of a heating roller, and applying the powder particles onto the recording medium via the heating roller (application process). Hereinafter, each process is described.

1. Recording Process

In the recording process of the present invention, images are recorded on a recording medium by an inkjet method.

Inkjet Method

The inkjet method is not particularly limited, and may be any known method such as a charge-control method in which an ink is ejected by electrostatic attraction force; a drop-on-demand method (pressure-pulse method) in which a pressure of oscillation of a piezo element is utilized; an acoustic inkjet method in which an ink is ejected by radiation pressure generated by irradiation of ink with acoustic beams that have been converted from electric signals; and a thermal inkjet method in which an ink is ejected by a pressure generated by formation of bubbles caused by heating of ink (BUBBLEJET, registered trademark).

Examples of the inkjet method include a method in which a large number of small-volume droplets of an ink having a low concentration, which is called a photo ink, are ejected; a method in which inks having substantially the same hue but at different concentrations are used to improve image quality; and a method in which a clear and colorless ink is used.

The inkjet head used in an inkjet method may be either an on-demand type head or a continuous type head. Examples of ejection systems include electromechanical transduction systems (such as a single-cavity system, a double-cavity system, a vendor system, a piston system, a share-mode system and a shared-wall system), electrothermal transduction systems (such as a thermal inkjet system and a BUBBLE-JET (registered trademark) system), electrostatic suction systems (such as an electric-field-control system and a slit-jet system), and discharge systems (such as a spark jet system), and any of these ejection systems is applicable.

The ink nozzles and the like used for the inkjet recording are not particularly limited, and may be selected as appropriate according to purposes.

Regarding the inkjet head, there are (i) a shuttle system in which recording is performed while a short serial head having a small length is moved in the width direction of a recording medium in a scanning manner, and (ii) a line system in which a line head having recording devices that are aligned to correspond to the entire length of one side of a recording medium is used. In the line system, image recording can be performed over the whole of one surface of a recording medium by moving the recording medium in a direction orthogonal to the direction along which the recording devices are aligned, and a conveyance system, such as carriage, which moves the short head in a scanning manner is unnecessary. Since a complicated scan-movement control of the movement of the carriage and the recording medium is unnecessary and only the recording medium is moved, the recording speed can be increased compared to the shuttle system. The inkjet recording method of the invention can be applied to both of these systems; effects in improving the ejection accuracy and scratch resistance of an image are larger when the image forming method of the invention is applied to a line system, in which dummy ejection is generally not performed.

The ink amount per droplet ejected from the inkjet head is preferably from 0.5 pl to 15 pl, more preferably from 1 pl to 12 pl, and still more preferably from 2 pl to 10 pl, from the viewpoint of obtaining a high resolution image.

Recording Medium

According to the inkjet method of the invention, an image is recorded on a recording medium.

The recording medium is not particularly limited, and may be a cellulose-based general printing paper, such as high-quality paper, coat paper, or art paper, that is used for general offset printing and the like.

The recording medium may be a commercially-available product, and examples thereof include high-quality papers (A) such as PRINCE WOOD FREE (tradename) manufactured by Oji Paper Co., Ltd., SHIRAOI (tradename) manufactured by Nippon Paper Industries Co., Ltd., and New NPI jo-shitsu (New NPI high-quality; tradename) manufactured by Nippon Paper Industries Co., Ltd.; very light-weight coated papers such as EVER LIGHT COATED (tradename) manufactured by Oji Paper Co., Ltd. and AURORA S (tradename) manufactured by Nippon Paper Industries Co., Ltd.; lightweight coat papers (A3) such as TOPKOTE (L) (tradename) manufactured by Oji Paper Co., Ltd. and AURORA L (tradename) manufactured by Nippon Paper Industries Co., Ltd.; coat papers (A2, B2) such as TOPKOTE PLUS (tradename) manufactured by Oji Paper Co., Ltd. and AURORA COAT (tradename) manufactured by Nippon Paper Industries Co., Ltd.; and art papers (A1) such as 2/SIDE GOLDEN CASK GLOSS (tradename) manufactured by Oji Paper Co., Ltd. and TOKUBISHI ART (tradename) manufactured by Mitsubishi Paper Mills Ltd. As the recording medium, various inkjet-recording papers exclusively for photos may be used.

Among the recording media, coated paper, which is used for general offset printing, is preferable. The coated paper is produced generally by coating a surface of cellulose-based paper (such as high-quality paper or neutral paper) that has not been subjected to surface treatment, with a coating material so as to form a coating layer. In particular, it is preferable to use a coated paper having base paper and a coated layer including kaolin and/or calcium bicarbonate. Specifically, art paper, coat paper, lightweight coat paper, or very light-weight coated paper is preferable.

Ink Composition

An ink composition used for the present invention is not limited as long as it contains a colorant and water, and a well-known or commercially available one may be used.

Colorant

As the colorant, for example, a well-known dye and pigment may be used with no particular limitation. Among them, from the viewpoints of the ink coloring property, a colorant which is almost water-insoluble or poorly water-soluble is preferable. Specific examples thereof include pigments, dispersive dyes, oil-soluble dyes, coloring matters forming J-aggregates, and, of these, pigments are more preferable. In the present invention, a water-insoluble pigment or a pigment surface-treated by a dispersant can be used as the colorant.

The pigment in the present invention is not particularly limited in terms of type, and known organic and inorganic pigments may be used. Examples of the pigment include polycyclic pigments, such as an azo lake, an azo pigment, a phthalocyanine pigment, a perylene pigment, a perynone pigment, an anthraquinone pigment, a quinacridone pigment, a dioxazine pigment, a diketopyrolopyrrole pigment, a thioindigo pigment, an isoindolinone pigment, and a quinophthalone pigment; dye lakes, such as a basic dye-type lake and an acidic dye-type lake, or organic pigments, such as a nitro pigment, a nitroso pigment, aniline black, and daylight fluorescent pigments; and inorganic pigments, such as titanium oxide, iron oxide-based inorganic pigments, and carbon black-based inorganic pigments. In addition, any pigments can be used as long as they can be dispersed in an aqueous phase, even if not described in the Color Index. Furthermore, the above pigments surface-treated with, for example, a surfactant or a polymer dispersant, or a grafted carbon can also be used. Among the above pigments, more preferable examples of the pigment includes azo pigments, phthalocyanine pigments, anthraquinone pigments, quinacridone pigments, and carbon black-based pigments.

Specific examples of the organic pigments used in the present invention are shown in the below. With respect to the following colorants, one kind may be used alone, or two or more kinds may be used in combination.

Examples of the organic pigments for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 74, C.I. pigment yellow 93, C.I. pigment yellow 94, C.I. pigment yellow 128, C.I. pigment yellow 138, C.I. pigment yellow 151, C.I. pigment yellow 155, C.I. pigment yellow 180, and C.I. pigment yellow 185.

Examples of the organic pigments for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222, and C.I. pigment violet 19.

Examples of the organic pigments for green or cyan include C.I. pigment blue 15, C.I. pigment blue 15:2, C.I. pigment blue 15:3, C.I. pigment blue 15:4, C.I. pigment blue 16, C.I. pigment blue 60, C.I. pigment green 7, and siloxane-bridged aluminum phthalocyanine described in the specification of U.S. Pat. No. 4,311,775.

Examples of the organic pigments for black include C.I. pigment black 1, C.I. pigment black 6, and C.I. pigment black 7.

In a case in which the coloring material in the present invention is a pigment, the coloring material may be dispersed in a water-based solvent by a dispersant. The dispersant may be a polymer dispersant or a low molecular-weight surfactant-type dispersant. The polymer dispersant may be any of a water-soluble dispersant and a water-insoluble dispersant.

As the water-soluble dispersant of the polymer dispersant in the present invention, a hydrophilic polymer compound can be used, and examples of natural hydrophilic polymers include vegetal polymers, such as gum arabic, gum tragan, guar gum, karaya gum, locust bean gum, arabinogalacton, pectin, and quince seed starch; sea weed polymers, such as alginic acid, carrageenen, and agar; animal polymers, such as gelatin, casein, albumin, and collagen; and microorganism polymers, such as xanthan gum and dextran.

In addition, examples of chemically-modified hydrophilic polymer compound formed from a natural product as a raw material include cellulose polymers, such as methyl cellulose, ethyl cellulose, hydroxyethyl cellulose, hydroxypropyl cellulose, and carboxymethyl cellulose; starch polymers, such as sodium starch glycolate and sodium starch phosphate; and sea weed polymers, such as propylene glycol alginate.

Furthermore, examples of synthetic water-soluble polymer compounds include vinyl polymers, such as polyvinyl alcohol, polyvinyl pyrrolidone, and polyvinyl methyl ether; acrylic resins, such as polyacrylamide, polyacrylic acid or an alkali metal salt thereof, and water-soluble styrene acrylic acid resin, water-soluble styrene maleic acid resin, water-soluble vinyl naphthalene acrylic resin, water-soluble vinyl naphthalene malein acid resin, polyvinylpyrrolidone, polyvinylalcohol, alkali metal salts of β-naphthalenesulfonic acid formalin condensate, and polymer compounds having at the side chains thereof a salt of cationic functional group, such as quaternary ammonium or amino group.

As the water-insoluble dispersant of the polymer dispersant, a polymer having both a hydrophobic portion and a hydrophilic portion can be used, and examples thereof include styrene-(meth)acrylic acid copolymer, styrene-(meth)acrylic acid-(meth)acrylic acid ester copolymer, (meth)acrylic acid ester-(meth)acrylic acid copolymer, polyethylene glycol (meth)acrylate-(meth)acrylic acid copolymer, and styrene-maleic acid copolymer.

From the viewpoints of a good aggregating property when the treatment liquid comes into contact, the acid value of the polymer dispersant is preferably 100 mgKOH/g or less. Furthermore, the acid value is more preferably from 25 mgKOH/g to 100 mgKOH/g, and particularly preferably from 30 mgKOH/g to 90 mgKOH/g.

The average particle diameter of the colorant is preferably from 10 nm to 200 nm, more preferably from 10 nm to 150 nm, and still more preferably from 10 nm to 100 nm. If the average particle diameter is 200 nm or less, color reproducibility becomes more favorable, and droplet ejection property becomes more favorable when ejecting droplets by an inkjet method, and if the average particle diameter is 10 nm or more, light-fastness becomes more favorable. In addition, the particle size distribution of the colorant is not particularly limited, and may have any of wide distribution or mono-dispersed distribution. In addition, two or more kinds of colorants having a mono-dispersed distribution may be mixed and used.

From the viewpoints of image density, the content of the colorant in the ink composition is preferably from 1% by mass to 25% by mass, and more preferably from 2% by mass to 20% by mass, with respect to the ink composition.

Polymer Particles

The ink composition according to the present invention preferably includes polymer particles optionally. This can further improve, for example, the scratch resistance and fixability of images.

Examples of the polymer particles in the present invention include particles of resin having anionic groups, and specific examples of the resin include thermoplastic, thermosetting, or modified acryl-based, epoxy-based, polyurethane-based, polyether-based, polyamide-based, unsaturated polyester-based, phenol-based, silicone-based, or fluorine-containing resins; polyvinyl-based resin, such as vinyl chloride, vinyl acetate, polyvinyl alcohol, and polyvinyl butyral; polyester-based resin, such as alkyd resin and phthalic resin; amino-based materials, such as melamine resin, melamine-formaldehyde resin, aminonalkyd co-condensate resin, and urea resin; and co-polymers or mixtures thereof. Among them, anionic acryl-based resin can be obtained by polymerizing, for example, an acryl monomer having an anionic group (anionic group-containing acryl monomer) and, optionally, another monomer that can be copolymerized with the anionic group-containing acryl monomer in a solvent. Examples of the anionic group-containing acryl monomer include acryl monomers having one or more selected from the group consisting of a carboxy group, a sulfonic acid group, and a phosphonic acid group, and, among them, preferable examples of the anionic group-containing acryl monomer include acryl monomers having a carboxy group (for example, acrylic acid, methacrylic acid, crotonic acid, ethacrylic acid, propylacrylic acid, isopropylacrylic acid, itaconic acid, and fumaric acid), and more preferable examples of the anionic group-containing acryl monomer include acrylic acid and methacrylic acid. With respect to the polymer particles, one kind may be used alone, or two or more kinds may be used as a mixture.

The molecular weight range of the polymer particles in the present invention is, in terms of the weight-average molecular weight, preferably from 3,000 to 200,000, more preferably from 5,000 to 150,000, and still more preferably from 10,000 to 100,000. The weight-average molecular weight is measured by gel permeation chromatography (based on polystyrene-conversion).

The average particle diameter of the polymer particles is, in terms of the volume-average particle diameter, preferably in a range from 10 nm to 400 nm, more preferably in a range from 10 nm to 200 nm, still more preferably in a range from 10 nm to 100 nm, and particularly preferably in a range of from 10 nm to 50 nm. When the volume-average particle diameter is within the above range, for example, production suitability and storage stability may be improved. The average particle diameter of the polymer particles is obtained by measuring the volume-average particle diameter by a dynamic light scattering method using a NANOTRAC particle size distribution measuring device UPA-EX150 (trade name, manufactured by Nikkiso Co., Ltd.).

From the viewpoints of, for example, the glossiness of images, the content of the polymer particles in a liquid composition is preferably from 1% by mass to 30% by mass, and more preferably from 3% by mass to 20% by mass, with respect to the ink composition.

Water

The ink composition includes water, and the amount of water is not particularly limited. However, the content of water is preferably from 10% by mass to 99% by mass, more preferably from 30% by mass to 80% by mass, and still more preferably from 50% by mass to 70% by mass.

Organic Solvent

The ink composition may optionally include a water-soluble organic solvent in addition to water. Preferable examples of a water-soluble organic solvent include, from the viewpoints of the ejection property, alkyleneoxy alcohols. Furthermore, the ink composition further preferably includes two or more kinds of water-soluble organic solvents including at least one kind of alkyleneoxy alcohol and at least one kind of alkyleneoxy ether.

The alkyleneoxy alcohol is preferably propyleneoxy alcohol, and examples of the propyleneoxy alcohol include SUNNIX GP 250 and SUNNIX GP 400 (trade names, all manufactured by Sanyo Chemical Industries Ltd.).

Preferable examples of the alkyleneoxy alcohol ether include ethyleneoxy alkyl ether, the alkyl portion of which has from 1 to 4 carbon atoms or propyleneoxy alkyl ether the alkyl portion of which has from 1 to 4 carbon atoms. Examples of the alkyleneoxy alkyl ether include ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether.

Furthermore, in addition to the above hydrophilic organic solvent, the ink composition may optionally include one or more other organic solvents for the purposes of, for example, drying prevention, permeation acceleration, and viscosity adjustment.

Other Additives

In addition to the above components, the ink composition may optionally include one or more other additives. Examples of such other additives include known additives, such as a polymerizable compound that is polymerized by active energy rays, a polymerization initiator, an anti-fading agent, an emulsification stabilizer, a permeation accelerating agent, an ultraviolet absorbent, an antiseptic agent, an antifungal agent, a pH adjuster, a surface tension controller, a defoamer, a viscosity adjuster, a wax, a dispersion stabilizer, an anticorrosive agent, and a chelating agent. Any of theses other additives may be directly added after the preparation of the ink composition or during the preparation of the ink composition.

2. Application Process

In the application process of the present invention, the liquid including powder particles is supplied to the surface of the heating roller, and the powder particles are applied to the recording medium via the heating roller. Hereinafter, the liquid including powder particles may also be referred to as a "powder-particle containing liquid".

The powder particle-containing liquid includes powder particles and a liquid (hereinafter, may also be referred to as "first liquid"). The powder particle-containing liquid may optionally include one or more additional components.

The first liquid may be any liquid that can disperse the powder particles, but, in the present invention, the powder-particle containing liquid preferably includes a nonvolatile solvent as the first liquid. When a nonvolatile solvent is used in the powder particle-containing liquid, the coating property of the powder particle-containing liquid can be improved. The nonvolatile solvent in the present invention refers to a solvent which does not boil at 150° C. or less at 1 atmosphere. Examples of such a solvent include silicone oils or fluorine-containing oils, such as dimethyl silicone oil, fluorinated oil, fluorosilicone oil, and amino-modified silicone oil; and liquid paraffin. Among them, from the viewpoints of forming a uniform release agent layer on the surface layer of the heating roller and easily transferring the powder particles to the surface of a recorded image, silicone oil or fluorine-containing oil is preferable.

Examples of these liquids include dimethyl silicone oils, such as "KF-96-10cs," "KF-96-20cs", "KF-96-30cs," "KF-96-50cs," "KF-96-100cs," "KF-96-200cs," "KF-96-300cs," "KF-96-500cs," "KF-96-1000cs," "KF-96-3000cs," "KF-96-5000cs," "KF-96-10000cs" (trade names, all manufactured by Shin-Etsu Chemical Co., Ltd.), "SH200-10CS," "SH200-100CS," "SH200-1000CS," and "SH200-10000CS" (trade names, all manufactured by Dow Corning Toray Corporation);

Amino-modified silicone oils, such as "KF-393," "KF-859," "KF-860," "KF-861," "KF-864," "KF-865," "KF-867," "KF-868," "KF-869," "KF-6012," "KF-880," "KF-8002," "KF-8004," "KF-8005," "KF-877," "KF-8008," "KF-8010," "KF-8012," "X-22-3820W," "X-22-3939A," "X-22-161A," "X-22-161B," "X-22-1660B-3" (trade names, all manufactured by Shin-Etsu Chemical Co., Ltd.), "BY16-871," "BY16-853U," "FZ-3705," "SF8417," "BY16-849," "FZ-3785," "BY16-890," "BY16-208," "BY16-893," "FZ-3789," "BY16-878," and "BY16-891" (trade names, all manufactured by Dow Corning Toray Corporation);

Fluorosilicone oils, such as "FL-5," "X22-821," "X-22-822," "FL-100-100CS," "FL-100-450CS," "FL-100-1000CS," "FL-100-10000CS," (trade names, all manufactured by Shin-Etsu Chemical Co., Ltd.), "FS1265-300CS," "FS1265-1000CS," and "FS1265-10000CS" (trade names, all manufactured by Dow Corning Toray Corporation).

With respect to the first liquid, one kind may be used singly or two or more kinds may be used in combination.

The powder particles are not limited as long as they can suppress blocking. The powder particles may be either poorly water-soluble or water-insoluble, and, in the present invention, water-insoluble powder particles are preferable. When poorly water-soluble particles or water-insoluble powder particles, preferably water-insoluble particles, are used as the powder particles, it is possible to effectively prevent the lowering of the blocking suppression effect and the occurrence of unevenness on the recorded image surface, which are caused by the powder particles dissolving or permeating into the inside of the recorded image when the powder particles are applied on the recording image. In the present invention, the term 'water-insoluble' refers to a solubility in which an amount of dissolution is 5.0 parts by mass or less with respect to 100 parts by mass of water (25° C.). The powder particle-containing liquid in the present invention, containing the powder particles, is preferably in a dispersed state, i.e., the powder particle-containing liquid is preferably a powder particle dispersion liquid.

Examples of the powder particles include inorganic particles and organic particles. Specific examples of the inorganic particles include silica (silicon dioxide), titanium oxide, magnesium oxide, aluminum oxide, and calcium carbonate. Examples of the organic particles include polymethyl (meth)acrylate, polystyrene, and polyester. Among them, polymethyl (meth)acrylate or silica is preferable. Meanwhile, the polymethyl (meth)acrylate refers to at least one kind of polymethyl acrylate and polymethyl methacrylate (PMMA).

With respect to the powder particles, one kind may be used alone, or two or more kinds may be used in combination.

The volume-average particle diameter of the powder particles is 1 μm or more. This can suppress occurrence of blocking. From the viewpoints of obtaining a high quality printing sample without changing tactile sense of the printing sample, while attaining sufficient blocking suppression effects regardless of the basis weight of the recording medium, the volume-average particle diameter may be from 1 μm to 40 μm, preferably about from 5 μm to 35 μm, and more preferably about from 10 μm to 30 μm. Specifically, in a case where a recording medium having a basis weight of 127 g/m$^2$ or higher, such as a thick coat paper or a paper board for packing, is used, the volume average diameter of the powder particles is preferably from 10 μm to 30 μmm, from the viewpoint of suppressing stacker blocking The volume average particle diameter of the powder particles is measured with a MICROTRAC particle size distribution analyzer MT-3200 (trade name, available from Nikkiso Co., Ltd.) using a dry cell. There is no particular restriction on the particle size distribution of the powder particles, and the powder particles may have a mono-dispersed particle size distribution or may have a wide particle size distribution. When the ratio of the particles having a preferable particle diameter is larger, the blocking suppression effect may also be larger and, therefore, the powder particles having a mono-dispersed particle size distribution are preferably used.

The content of the powder particles included in the powder particle-containing liquid is not limited, and, for example, with respect to the total amount of the powder particle-containing liquid, the content may be about from 1% by mass to 50% by mass, and preferably about from 5% by mass to 40% by mass.

The surface temperature (heating temperature) of the heating roller is not limited as long as a film can be formed with the polymer particles in the ink composition at the surface temperature, but the temperature may be, for example, about from 30° C. to 120° C., and preferably about from 50° C. to 90° C. This can improve the film strength of images.

A heating method is not particularly limited, but preferable examples thereof include methods of heating in a non-contact manner, such as a method of heating with a heating element, such as a nichrome wire heater, a method of supplying a warm air or a hot air, and a method of heating with, for example, a halogen lamp or an infrared ray lamp.

The heating roller may be either a metal roller made of metal or a roller having, at the surface of a core made of metal, a coated layer made of an elastic body and, optionally, a surface layer (also called a releasing, layer). The metal roller and the core made of metal can be made of, for example, an iron, aluminum, or SUS-made cylindrical body. The coated layer is particularly preferably formed with a silicone resin or fluorine resin having a releasing property. The heating roller preferably has a heating element built in the inside of the core metal thereof. When, for example, two rollers are used, one of the two rollers may have a heating element built in the core metal thereof. Heating treatment and pressure-applying treatment may be conducted at the same time by passing a recording medium between rollers. Two heating rollers may be used, and heating may be conducted by passing the recording medium between the two heating rollers. Preferable examples of the heating element include a halogen lamp heater, a ceramic heater, and a nichrome wire.

The powder particles may be supplied to the heating roller by directly or indirectly attaching the liquid including the powder particles (powder particle-containing liquid) to the heating roller. Examples of such methods include a method in which a fabric material, into which the powder particle-containing liquid has been impregnated, is brought into contact with the surface of the heating roller, a method in which the powder particle-containing liquid is sprayed to the surface of the heating roller, and a method in which the powder particle-containing liquid is coated on the heating roller with a roll coater. In particular, the method in which a fabric material is brought into contact with the heating roller is preferable from the standpoint that an appropriate amount of the powder particle-containing liquid can be supplied to the roller surface without unevenness. The fabric material (web member) used in this method may be any of woven fabric and non-woven fabric, and commercially available or known materials may be used, but a heat-resistant nonwoven fabric is preferable since the fabric material is brought into contact with the heating roller. Examples of the heat-resistance nonwoven fabric include polyvinylidene chloride, polyethylene, aramide, polyester, polyamide and the mixtures thereof. The amount of the powder particle-containing liquid impregnated into the fabric material is not limited, but may be in a range of about from 1 $g/m^2$ to 100 $g/m^2$ (particularly 2 $g/m^2$ to 50 $g/m^2$).

In the application process in the present invention, the powder particles may be applied to the surface of a printed article by, for example, pressing the heating roller having the powder particles attached at the roller surface to a recording medium (printed article) on which an image has been recorded. The pressing method is not limited, and examples thereof include (i) a method in which a pressure-applying roller is additionally used and the recording medium passes between a pair of these rollers (heating roller and pressure-applying roller) in such a manner that the recorded image surface of the recording medium is brought into contact with the heating roller, (ii) a method in which two heating rollers are used and a recording medium passes between a pair of the heating rollers, (iii) a method in which the printed article, being conveyed on a conveying belt, passes in such a manner that the recorded image surface of the recording medium is brought into contact with the heating roller, and (iv) a combination thereof.

The application process of the present invention may include a process of fixing the recorded image (fixing process), before or after the process using a heating roller. In general, in the fixing process, it is necessary to use a fixing roller, which is a fixing member, but, in the present invention, the heating roller can serve as the fixing roller as well as a roller for the application of the powder particles. Therefore, it is possible to conduct the fixation of the recorded image and the application of the powder particles at the same time without using a separate fixing roller; whereby, equipment can be miniaturized. Meanwhile, a method in which the fixation is conducted by further using a fixing member, such as a separate fixing roller, is also included in the scope of the present invention.

The pressure for the pressing is not limited, but the pressure is preferably such a level that the powder particles are not crushed. As such a pressure, for example, the pressure is preferably in a range of from 0.1 MPa to 3.0 MPa, more preferably in a range of from 0.1 MPa to 1.0 MPa, and still more preferably in a range of from 0.1 MPa to 0.5 MPa.

The nip time of passing a recording medium through the heating roller is preferably from 1 millisecond to 10 seconds, more preferably from 2 milliseconds to 1 second, and still more preferably from 4 milliseconds to 100 milliseconds. The nip width is preferably from 0.1 mm to 100 mm, more preferably from 0.5 mm to 50 mm, and still more preferably from 1 mm to 10 mm.

To realize the above pressure (nip pressure), elastic members, such as springs, having a tensile force may be selected and installed at both ends of the rollers, such as the heating roller, so as to obtain a desirable nip pressure in consideration of the nip gap.

A belt substrate for conveying the recording medium is not limited, but, for example, seamless electroformed nickel is preferable, and a preferable thickness of the substrate is from 10 μm to 100 μm. Examples of materials for the belt substrate further include, other than nickel, aluminum, iron, and polyethylene. In the case of providing a silicone resin or a fluorine resin, the thickness of the layer formed with such a resin is preferably from 1 μm to 50 μm, and more preferably from 10 μm to 30 μm.

The conveying speed of the recording medium is preferably in a range of from 200 mm/second to 700 mm/second, more preferably from 300 mm/second to 650 mm/second, and still more preferably from 400 mm/second to 600 mm/second.

The amount of the powder particles applied to the recording medium is not limited, and can be appropriately adjusted by, for example, the amount supplied to the heating roller and the concentration of the powder particle-containing liquid. In a method in which a fabric material (web member) into which the powder particle-containing liquid has been impregnated is used, the amount can be adjusted by, for example, the amount impregnated into the fabric material and the amount of the fabric material delivered.

In the image forming method according to the present invention, a device such as an ink-drying zone may be provided, whereby drying process may be conducted between the recording process and the application process or after the application process.

An example of the application process in the present invention is described with reference to FIG. 1 as follows. The fabric material (web member) 5 into which the powder particle-containing liquid has been impregnated is pressed to the heating roller (fixing roller) 1 by the web-pressing roller 3. The fabric material 5 continuously supplies the powder particle-containing liquid to the surface of the heating roller by coming into contact with the heating roller 1 while being wound by the rotation of the delivery roller 2 and the winding roller 4.

A preferable example of the image forming method according to the present invention is described with reference to the schematic diagram of an apparatus shown in FIG. 2. In the apparatus, once the recording medium 11 is conveyed to by, for example the conveying belt 10, the recording medium is, first of all, applied with a treatment liquid by the treatment liquid-coating bar 13 at the treatment liquid-coating section 12, and, subsequently, dried by a dryer 15 at the heating and drying section 14. Then, when the recording medium has arrived at the inkjet recording section 16, the ink composition is ejected from the inkjet nozzle 17 toward the recording medium so as to form a recorded image on the recording medium. The recording medium (printed article) on which the image has been recorded is conveyed through another heating and drying section 14 to the fixing section. The fixing section is provided with the heating roller (fixing roller) 1 and the pressure-applying roller 6.

The heating roller has been pressed by the fabric material 5, part of which had been impregnated with the powder particle-containing liquid, consequently, powder particles are attached to the surface of the roller. The conveyed printed article passes between the heating roller 1 and the pressure-applying roller 6. By this passing, the image formed on the recording medium is fixed and the powder particles attached to the surface of the heating roller are transferred to the surface of the printed article. After that, the recording medium is optionally cut into a predetermined size, and is ejected from an ejection outlet, whereby printed articles are stacked on an ejection tray (not shown).

Meanwhile, in FIG. 2, the treatment liquid-coating section 12 is provided and a treatment liquid application process (described below) is conducted on the surface of the recording medium by bringing the treatment liquid-coating bar into contact with the surface of the recording medium. Furthermore, in FIG. 2, the heating and drying sections 14 are provided after the treatment liquid-coating section 12 and the inkjet-recording section 16, respectively, so as to conduct the drying processes. However, the treatment liquid application process and heating process are not essential.

—Treatment Liquid Application Process—

The image forming method of the present invention may further include a treatment liquid application process in which the treatment liquid is applied to a recording medium. In the treatment liquid application process, the treatment liquid capable of causing formation of an aggregate when contacting with the ink composition is applied to a recording medium, thereby contacting the treatment liquid with the ink composition, to form an image. When the treatment liquid contacts with the ink composition, dispersed particles, such as polymer particles and a colorant (for example, a pigment), in the ink composition aggregate, as a result of which an image is fixed to the recording medium.

The application of the treatment liquid can be performed employing a known method such as a coating method, an inkjet method, or a dip method. The coating method may be a known coating method such as a method using a bar coater, an extrusion die coater, an air doctor coater, a blade coater, a rod coater, a knife coater, a squeeze coater, a reverse roll coater, or the like. The specifics of the inkjet method are as described above.

The treatment liquid application process may be conducted either before or after the ink application process (recording process) in which the ink composition is used.

In the invention, it is preferable that the recording process is conducted after applying the treatment liquid in the treatment liquid application process. That is, it is preferable that the treatment liquid for aggregating a colorant (preferably a pigment) in the ink composition is applied onto the recording medium in advance of the application of the ink composition, and the ink composition is applied so as to contact with the treatment liquid that has been applied onto the recording medium, thereby forming an image. Inkjet recording at higher speeds can be realized, and an image having high density and high resolution can be obtained even when high-speed recording is performed.

The amount of the treatment liquid to be applied is not particularly limited as long as the treatment liquid is capable of causing aggregation when contacting with the ink composition. The amount of the treatment liquid to be applied is preferably such an amount that the amount of aggregating component (such as a di- or higher-valent carboxylic acid or a cationic organic compound) is from 0.1 $g/m^2$ or higher. The amount of the treatment liquid is more preferably such that the amount of the aggregating component applied is from 0.1 to 1.0 $g/m^2$, still more preferably such that the amount of the aggregating component applied is from 0.2 to 0.8 $g/m^2$. When the amount of the aggregating component applied is 0.1 $g/m^2$ or higher, the aggregation reaction proceeds favorably. The amount of the aggregating component applied of 1.0 $g/m^2$ or less is preferable from the viewpoint of glossiness.

The treatment liquid in the invention is capable of causing aggregation when contacting with the ink composition as described above. Specifically, the treatment liquid preferably includes an aggregating component capable of causing formation of an aggregate by aggregating dispersed particles, such as colorant particles (pigment and the like), contained in the ink composition. The treatment liquid may further include other components, as necessary. Use of the treatment liquid with the ink composition realizes inkjet recording at higher speeds, and realizes formation of an image having high density, high resolution, and excellent print properties (such as reproduction of thin lines and fine areas) even at high recording speeds.

The treatment liquid may include at least one aggregating component capable of causing formation of an aggregate when contacting with the ink composition. As a result of the treatment liquid mixing into the ink composition ejected by an inkjet method, aggregation of, for example, pigment and the like that have been stably dispersed in the ink composition is promoted.

The treatment liquid is, for example, a liquid that is capable of causing formation of an aggregate by changing the pH of the ink composition. In this case, the pH (at 25° C. ° C.) of the treatment liquid is preferably from 1 to 6, more preferably from 1.2 to 5, and still more preferably from 1.5 to 4, from the viewpoint of the aggregation speed of the ink composition. In this case, the pH (at 25° C.) of the ink composition to be ejected is preferably from 7.5 to 9.5, and more preferably from 8.0 to 9.0.

In the invention, it is preferable that the pH (at 25° C.) of the ink composition is 7.5 or higher and the pH of the treatment liquid (at 25° C.) is from 1.5 to 3, from the viewpoints of image density, resolution, and inkjet recording at higher speeds.

The aggregating component may be used singly, or two or more thereof may be used in mixture.

The treatment liquid may include at least one acidic compound as an aggregating component. Examples of acidic compounds that can be used include compounds having a phosphoric acid group, a phosphonic acid group, a phosphinic acid group, a sulfuric acid group, a sulfonic acid group, a sulfinic acid group, or a carboxyl group, and salts thereof (such as polyvalent metal salts thereof). From the viewpoint of aggregation speed of the ink composition, compounds having a phosphoric acid group or a carboxyl group are preferable, and compounds having a carboxyl group are more preferable.

The compounds having a carboxyl group are preferably selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumalic acid, thiophenecarboxylic acid, and nicotinic acid, derivatives of these compounds, and salts thereof (such as polyvalent metal salts thereof).

These compounds may be used singly, or in combination of two or more thereof.

The treatment liquid in the present invention may further include an aqueous solvent (for example, water) in addition to an acidic compound.

The content of the at least one acidic compound in the treatment liquid is preferably from 5% by mass to 95% by mass, more preferably from 10% by mass to 80% by mass, still more preferably from 15% by mass to 50% by mass, and further preferably from 18% by mass to 30% by mass, relative to the total mass of the treatment liquid, from the viewpoint of aggregation effect.

The treatment liquid may include, as an aggregating component, a polyvalent metal salt. Use of this treatment liquid improves high-speed aggregation properties. Examples of the polyvalent metal salt include: a salt of an alkaline earth metal, which belongs to Group 2 of the Periodic Table, such as magnesium or calcium; a salt of a transition metal belonging to Group 3 of the Periodic Table, such as lanthanum; a salt of a metal belonging to Group 13 of the Periodic Table, such as aluminum; and a salt of a lanthanide, such as neodymium. The salt of such a metal is preferably a carboxylic acid salt (such as a formate, acetate, or benzoate), a nitrate, a chloride, or a thiocyanate. In particular, the following salts are preferable: a calcium or magnesium salt of a carboxylic acid (such as formic acid, acetic acid, or benzoic acid); a calcium or magnesium salt of nitric acid; calcium chloride; magnesium chloride; and a calcium or magnesium salt of thiocyanic acid.

The content of polyvalent metal salt in the treatment liquid is preferably from 1% by mass to 10% by mass, more preferably from 1.5% by mass to 7% by mass, and still more preferably from 2% by mass to 6% by mass, form the viewpoint of aggregation effects.

The treatment liquid may include at least one cationic organic compound as an aggregating component. Examples of the cationic organic compound include cationic polymers such as a poly(vinylpyridine) salt, poly(alkylaminoethyl acrylate), poly(alkylaminoethyl methacrylate), poly(vinylimidazol), polyethyleneimine, polybiguanide, polyguanide, and polyallylamine, and derivatives thereof.

The weight average molecular weight of the cationic polymer is preferably smaller from the viewpoint of the viscosity of the treatment liquid. When the treatment is applied to a recording medium by an inkjet method, the weight average molecular weight of the cationic polymer is preferably in the range of from 1,000 to 500,000, more preferably from 1,500 to 200,000, and still more preferably from 2,000 to 100,000. A weight average molecular weight of 1000 or more is preferable in terms of aggregation speed, and a weight average molecular weight of 500,000 or less is preferable in terms of ejection reliability. The above preferable ranges do not apply when the treatment liquid is applied to a recording medium by methods other than inkjet.

The cationic organic compound is preferably, for example, a primary, secondary, or tertiary amine salt-type compound. Examples of the amine salt-type compound include a cationic amine salt-type compound and an amphoteric surfactant that exhibits cationic properties at a desired pH range. Examples of the cationic amine salt-type compound include: hydrochloride or acetate of an amine, such as hydrochloride or acetate of laurylamine, cocoamine, stearylamine, rosin amine, or the like; a quaternary ammonium salt compound such as lauryl trimethyl ammonium chloride, cetyl trimethyl ammonium chloride, lauryl dimethyl benzyl ammonium chloride, benzyl tributyl ammonium chloride, or benzalkonium chloride; a pyridinium salt compound such as cetylpyridinium chloride or cetylpyridinium bromide; an imidazoline-based cationic compound such as 2-heptadecenyl-hydroxyethyl imidazoline; and an ethyleneoxide adduct of a higher alkylamine such as dihydroxyethyl stearylamine. Examples of the amphoteric surfactant that exhibits cationic properties at a desired pH range include: amino acid-type amphoteric surfactant, a carboxylate-type amphoteric surfactant such as stearyl dimethyl betaine or lauryl dihydroxyethyl betaine, a sulfuric ester-type amphoteric surfactant, a sulfonic acid-type amphoteric surfactant, and a phosphoric ester-type amphoteric surfactant.

Among them, a di- or higher valent cationic organic compound is preferable.

The content of the at least one cationic organic compound in the treatment liquid is preferably from 1% by mass to 50% by mass, and more preferably from 2% by mass to 30% by mass, from the viewpoint of aggregation effects.

Among them, a di- or higher-valent carboxylic acid or a di- or higher-valent cationic organic compound is preferable as an aggregating component, from the viewpoints of aggregation properties and scratch resistance of an image.

The viscosity of the treatment liquid is preferably in the range of from 1 mPa·s to 30 mPa·s, more preferably from 1 mPa·s to 20 mPa·s, and still more preferably from 2 mPa·s to 15 mPa·s, and particularly preferably from 2 mPa·s to 10 mPa·s, from the viewpoint of the aggregation speed of the ink composition. Here, the viscosity is measured using a VISCOMETER TV-22 (tradename, manufactured by TOKI SANGYO CO. LTD) at 20° C.

The surface tension of the treatment liquid is preferably from 20 mN/m to 60 mN/m, more preferably from 20 mN/m to 45 mN/m, and still more preferably from 25 mN/m to 40 mN/m, from the viewpoint of the aggregation speed of the ink composition. Here, the surface tension is measured using an automatic surface tensiometer CBVP-Z (tradename, manufactured by Kyowa Interface Science Co., Ltd.) at 25° C.

In general, the treatment liquid of the invention may include a water-soluble organic solvent, in addition to the aggregating component.

The treatment liquid may further include one or more other various additives, as long as the effects of the invention are not impaired. The specifics of the water-soluble organic solvent are the same as the specifics of the above-described hydrophilic organic solvent in the ink composition.

Examples of other additives include a known additive such as an anti-drying agent (humectant), an anti-fading agent, an emulsification stabilizer, a permeation accelerator, a UV absorber, an antiseptic agent, an antifungal agent, a pH adjuster, a surface tension controller, a, defoamer a viscosity adjuster, a dispersant, a dispersion stabilizer, an antirust agent, or a chelating agent. The additives described as specific examples of other additives contained in the ink composition in the above description may be used as other additives in the treatment liquid.

EXAMPLES

Hereinafter, the present invention is described in detail with examples, but the present invention is not limited to the following examples as long as it does not depart from the gist thereof. Meanwhile, unless otherwise described, "parts" are mass-based.

The weight average molecular weights were measured using a gel permeation chromatography (GPC). The GPC was performed using a GPC instrument, HLC-8220GPC manufactured by Tosoh Corporation, three serially-connected columns of TSKGEL SUPER HZM-H, TSKGEL SUPER HZ4000, and TSKGEL SUPER HZ2000 (tradenames, all manufactured by Tosoh Corporation), and THF (tetrahydrofuran) as an eluent. Regarding the GPC conditions, the sample concentration was 0.45% by mass, the flow rate was 0.35 ml/min, the sample injection amount was 10 μl, and the measurement temperature is 40° C. The detection was performed by using a refractive index detector. The calibration curve was determined from the following eight standard samples: TSK STANDARD POLYSTYRENEs of F-40, F-20, F-4, F-1, A-5000, A-2500, A-1000, and n-propylbenzene, all manufactured by Tosoh Corporation.

The acid values were measured by the method defined by JIS standard (JIS K0070: 1992), the disclosure of which is incorporated by reference herein.

The volume average particle diameters of powder particles were measured with a MICROTRAC particle size distribution analyzer MT-3200 (trade name, available from Nikkiso Co., Ltd.).

<Preparation of Ink Composition>

(Composition of Cyan Ink C1)

A cyan ink C1 was prepared to have the following composition.

| | |
|---|---|
| Cyan pigment (pigment blue 15:3): | 4% by mass |
| Acrylic-based dispersant (acid value: 65.2 mgKOH/g, weight-average molecular weight: 44600): | 2% by mass |
| Acrylic-based polymer particles (weight-average molecular weight: 66000): | 4% by mass |
| SUNNIX GP250: (trade name, manufactured by Sanyo Chemical Industries Ltd., water-soluble organic solvent) | 10% by mass |
| Tripropylene glycol monoethyl ether: (manufactured by Wako Pure Chemical Industries Ltd., water-soluble organic solvent) | 10% by mass |
| OLFINE E1010 (trade name, manufactured by Nissin Chemical Industry Co., Ltd., surfactant): | 1% by mass |
| Microcrystalline wax: (manufactured by Nippon Seiro Co., Ltd., HI-MIC 1090, trade name) | 2% by mass |

Ion-exchange water was added to the above components so as to make 100% by mass.

(Composition of Magenta Ink M1)

A magenta ink M1 was prepared to have the same composition as the cyan ink C1 except that the cyan pigment in the composition of the cyan ink C1 was changed to a magenta pigment (pigment red 122) in the same amount as the pigment.

(Composition of Yellow Ink Y1)

A yellow ink Y1 was prepared to have the same composition as the cyan ink C1 except that the cyan pigment in the composition of the cyan ink C1 was changed to a yellow pigment (pigment yellow 74) in the same amount as the pigment.

(Composition of Black Ink K1)

A black ink K1 was prepared to have the same composition as the cyan ink C1 except that the cyan pigment in the composition of the cyan ink C1 was changed to a black pigment (carbon black) in the same amount as the pigment.

<Preparation of Treatment Liquid>

A treatment liquid was prepared by mixing each component so as to have the following composition.

| | |
|---|---|
| Malonic acid (divalent carboxylic acid, manufactured by Wako Pure Chemical Industries Ltd.) | 15.0% by mass |
| Diethylene glycol monomethyl ether (manufactured by Wako Pure Chemical Industries Ltd.) | 20.0% by mass |
| Sodium N-Oleoyl-N-methyl taurine (surfactant) | 1.0% by mass |
| Ion-exchange water | 64.0% by mass |

The treatment liquid had a viscosity of 2.6 mPa·s, a surface tension of 37.3 mN/m, and a pH of 1.6. Meanwhile, the surface tension was measured at 25° C. by the Wilhelmy method using a platinum plate, using an automatic surface tensiometer CBVP-Z (trade name, manufactured by Kyowa Interface Science Co., Ltd.). The viscosity was measured at 30° C. using a viscometer TV-22 (trade name, manufactured by Toki Sangyo Co., Ltd.). The pH measurement was performed on the undiluted liquid at 25° C. using a pH meter WM-50EG (trade name, manufactured by DKK Toa Corporation).

—Web Member 1—

| | |
|---|---|
| Silicone oil: ("KF-96-100cs," trade name, manufactured by Shin-Etsu Chemical Co., Ltd.) | 85.0% by mass |
| Polymethyl metacrylate (PMMA) particles: (manufactured by Nippon Shokubai Co., Ltd., | 15.0% by mass |

-continued

| | |
|---|---|
| "EPOSTAR MA 1010," trade name, volume-average particle diameter: 10 μm) | |

A powder particle dispersion liquid 1 was prepared by mixing 1 L of a liquid with the above composition with an emulsification device manufactured by Silverson Machines, Inc. at 8000 rpm for 10 minutes. A web member 1 was manufactured by impregnating the powder particle dispersion liquid 1 into a nonwoven fabric so as to have an impregnating amount of the dispersion liquid of 30 g/m$^2$. The nonwoven fabric used was a mixed material of polyamide and polyester with a weight of 30 g/m$^2$ and a thickness of 0.1 mm.

—Web Member 2—

| | |
|---|---|
| Silicone oil: ("KF-96-100cs," trade name, manufactured by Shin-Etsu Chemical Co., Ltd.) | 85.0% by mass |
| PMMA particles: (manufactured by Soken Chemical & Engineering Co., Ltd., "MX-6," trade name, volume-average particle diameter: 6 μm) | 15.0% by mass |

A powder particle dispersion liquid 2 was prepared by mixing 1 L of a liquid with the above composition with an emulsification device manufactured by Silverson Machines, Inc. at 8000 rpm for 10 minutes. A web member 2 was manufactured by impregnating the powder particle dispersion liquid 2 into a nonwoven fabric so as to have an impregnating amount of the dispersion liquid of 30 g/m$^2$. The nonwoven fabric used for this web member is the same as that for the web member 1.

—Web Member 3—

| | |
|---|---|
| Silicone oil: ("KF-96-100cs," trade name, manufactured by Shin-Etsu Chemical Co., Ltd.) | 85.0% by mass |
| PMMA particles: (manufactured by Soken Chemical & Engineering Co., Ltd., "MX-1500," trade name, volume-average particle diameter 15 μm) | 15.0% by mass |

A powder particle dispersion liquid 3 was prepared by mixing 1 L of a liquid with the above composition with an emulsification device manufactured by Silverson Machines, Inc. at 8000 rpm for 10 minutes. A web member 3 was manufactured by impregnating the powder particle dispersion liquid 3 into a nonwoven fabric so as to have an impregnating amount of the dispersion liquid of 30 g/m$^2$. The nonwoven fabric used for this web member is the same as that for the web member 1.

—Web Member 4—

| | |
|---|---|
| Silicone oil: ("KF-96-100cs," trade name, manufactured by Shin-Etsu Chemical Co., Ltd.) | 85.0% by mass |
| Silica particles: (manufactured by Cabot Corporation, "CAB-O-SIL TG-820F," trade name, volume-average particle diameter: 10 μm) | 15.0% by mass |

A powder particle dispersion liquid 4 was prepared by mixing 1 L of a liquid with the above composition with an emulsification device manufactured by Silverson Machines, Inc. at 8000 rpm for 10 minutes. A web member 4 was manufactured by impregnating the powder particle dispersion liquid 4 into a nonwoven fabric so as to have an impregnating amount of the dispersion liquid of 30 g/m$^2$. The nonwoven fabric used for this web member is the same as that for the web member 1.

—Web Member 5—

| | |
|---|---|
| Silicone oil ("KF-96-100cs," trade name, manufactured by Shin-Etsu Chemical Co., Ltd.) | 100.0% by mass |

A web member 5 was manufactured by impregnating the above silicone oil into a nonwoven fabric so as to have an impregnating amount of the dispersion liquid of 30 g/m$^2$. The nonwoven fabric used for this web member is the same as that for the web member 1.

—Web Member 6—

| | |
|---|---|
| Silicone oil ("KF-96-100cs," trade name, manufactured by Shin-Etsu Chemical Co., Ltd.) | 85.0% by mass |
| PMMA particles (manufactured by Soken Chemical & Engineering Co., Ltd., "MP-1600", trade name, volume-average particle diameter: 0.8 μm) | 15.0% by mass |

A powder particle dispersion liquid 6 was prepared by mixing 1 L of a liquid with the above composition with an emulsification device manufactured by Silverson Machines, Inc. at 8000 rpm for 10 minutes. A web member 6 was manufactured by impregnating the powder particle dispersion liquid 6 into a nonwoven fabric so as to have an impregnating amount of the dispersion liquid 30 g/m$^2$. The nonwoven fabric used for this web member is the same as that for the web member 1.

—Web Member 11—

| | |
|---|---|
| Silicone oil ("KF-96-100cs," trade name, manufactured by Shin-Etsu Chemical Co., Ltd.) | 70.0% by mass |
| PMMA particles (manufactured by Soken Chemical & Engineering Co., Ltd., "CHEMISNOW MX-800", trade name, volume-average particle diameter: 8 μm) | 30.0% by mass |

A powder particle dispersion liquid 11 was prepared by mixing 1 L of a liquid with the above composition with an emulsification device manufactured by Silverson Machines, Inc. at 8000 rpm for 10 minutes. A web member 11 was manufactured by impregnating the powder particle dispersion liquid 11 into a nonwoven fabric so as to have an impregnating amount of the dispersion liquid 140 g/m$^2$. As the nonwoven fabric, KYS-80 (trade name, manufactured by Kureha Ltd.) having a weight of 80 g/m$^2$ and a thickness of 0.3 mm was used.

—Web Member 12—

| | |
|---|---|
| Silicone oil ("KF-96-100cs," trade name, manufactured by Shin-Etsu Chemical Co., Ltd.) | 70.0% by mass |
| Crosslinked polystyrene particles (manufactured by Sekisui Kasei Plastics Co., Ltd., "TECHPOLYMER SBX-17", trade name, volume-average particle diameter: 16 μm) | 30.0% by mass |

A powder particle dispersion liquid 12 was prepared by mixing 1 L of a liquid with the above composition with an emulsification device manufactured by Silverson Machines, Inc. at 8000 rpm for 10 minutes. A web member 12 was manufactured by impregnating the powder particle dispersion liquid 12 into a nonwoven fabric so as to have an impregnating amount of the dispersion liquid 140 g/m$^2$. As the nonwoven fabric, KYS-80 (trade name, manufactured by Kureha Ltd.) as described above was used.

—Web Member 13—

| | |
|---|---|
| Silicone oil ("KF-96-100cs," trade name, manufactured by Shin-Etsu Chemical Co., Ltd.) | 70.0% by mass |
| PMMA particles (manufactured by Soken Chemical & Engineering Co., Ltd.,"CHEMISNOW MX-2000", trade name, volume-average particle diameter: 20 μm) | 30.0% by mass |

A powder particle dispersion liquid 13 was prepared by mixing 1 L of a liquid with the above composition with an emulsification device manufactured by Silverson Machines, Inc. at 8000 rpm for 10 minutes. A web member 13 was manufactured by impregnating the powder particle dispersion liquid 13 into a nonwoven fabric so as to have an impregnating amount of the dispersion liquid 140 g/m$^2$. As the nonwoven fabric, KYS-80 (trade name, manufactured by Kureha Ltd.) as described above was used.

—Web Member 14—

| | |
|---|---|
| Silicone oil ("KF-96-100cs," trade name, manufactured by Shin-Etsu Chemical Co., Ltd.) | 70.0% by mass |
| PMMA particles (manufactured by Soken Chemical & Engineering Co., Ltd., "CHEMISNOW MX-3000", trade name, volume-average particle diameter: 30 μm) | 30.0% by mass |

A powder particle dispersion liquid 14 was prepared by mixing 1 L of a liquid with the above composition with an emulsification device manufactured by Silverson Machines, Inc. at 8000 rpm for 10 minutes. A web member 14 was manufactured by impregnating the powder particle dispersion liquid 14 into a nonwoven fabric so as to have an impregnating amount of the dispersion liquid 140 g/m$^2$. As the nonwoven fabric, KYS-80 (trade name, manufactured by Kureha Ltd.) as described above was used.

—Web Member 15—

| | |
|---|---|
| Silicone oil ("KF-96-100cs," trade name, manufactured by Shin-Etsu Chemical Co., Ltd.) | 70.0% by mass |

-continued

| | |
|---|---|
| Crosslinked poly(methyl methacrylate) particles (manufactured by Sekisui Kasei Plastics Co., Ltd., "TECHPOLYMER MBX-40", trade name, volume-average particle diameter: 40 μm) | 30.0% by mass |

A powder particle dispersion liquid 15 was prepared by mixing 1 L of a liquid with the above composition with an emulsification device manufactured by Silverson Machines, Inc. at 8000 rpm for 10 minutes. A web member 15 was manufactured by impregnating the powder particle dispersion liquid 15 into a nonwoven fabric so as to have an impregnating amount of the dispersion liquid 140 g/m$^2$. As the nonwoven fabric, KYS-80 (trade name, manufactured by Kureha Ltd.) as described above was used.

—Web Member 16—

| | |
|---|---|
| Silicone oil ("KF-96-100cs," trade name, manufactured by Shin-Etsu Chemical Co., Ltd.) | 70.0% by mass |
| PMMA particles (manufactured by Soken Chemical & Engineering Co., Ltd., "CHEMISNOW MX-6", trade name, volume-average particle diameter: 0.6 μm) | 30.0% by mass |

A powder particle dispersion liquid 16 was prepared by mixing 1 L of a liquid with the above composition with an emulsification device manufactured by Silverson Machines, Inc. at 8000 rpm for 10 minutes. A web member 16 was manufactured by impregnating the powder particle dispersion liquid 16 into a nonwoven fabric so as to have an impregnating amount of the dispersion liquid 140 g/m$^2$. As the nonwoven fabric, KYS-80 (trade name, manufactured by Kureha Ltd.) as described above was used.

<Image Recording and Evaluation>

As shown below, images were recorded using the inks C1, M1, Y1 and K1 and evaluated in the following manner. The evaluation results are shown in Tables 1 and 2 below.

—Scratch Resistance—

A GELJET GX5000 printer head (trade name, a full-line head manufactured by Ricoh Company Ltd.) was prepared, and a storage tank linked to the printer head was refilled with the above-obtained cyan ink C1, magenta ink M1, yellow ink Y1, and black ink K1. As a recording medium, a TOKUBISHI ART DOUBLE-SIDED N (trade name, manufactured by Mitsubishi Paper Mills Limited, basis weight of 104.7 g/m$^2$) and those described in Table 2 were prepared. Each recording medium was fixed on a stage (conveying belt) movable in a predetermined linear direction at 500 mm/second. The recording medium was then coated with the above-obtained treatment liquid by a wire bar coater so as to have a thickness of about 1.5 μm (equivalent to 0.34 g/m$^2$ of maloic acid), and dried at 50° C. for 2 seconds immediately after the coating (FIG. 2).

Then, the GELJET GX5000 printer head (trade name, a full-line head manufactured by Ricoh Company Ltd.) was disposed and fixed in a manner such that the direction of the line head in which the nozzles were arranged (primary scanning direction) formed an angle of 75.7 degrees with respect to a direction perpendicular to the moving direction of the stage (secondary scanning direction), and evaluation samples were obtained by printing solid images by ejecting the inks in a line method under the ejection conditions of an ink droplet amount of 3.5 μL, an ejection frequency of 24 kHz, and a resolution of 1200 dpi×600 dpi, while moving the recording medium in the secondary scanning direction at a constant speed. Immediately after printing, the evaluation samples were dried at 60° C. for 3 seconds.

Figure 2:
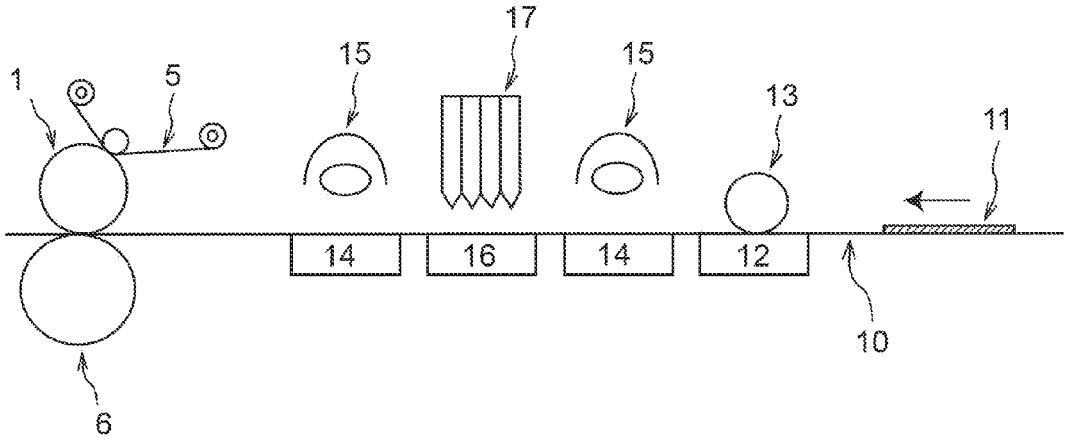
FIG. 2 is a schematic diagram of an apparatus for the image forming method according to the present invention.

Next, using the web members as shown in Tables 1 and 2 for Examples 1 to 19 and Comparative Examples 1 to 5 respectively, each of the web members installed as shown in FIG. 2 was brought into contact with a heating roller, and the powder particles impregnated in the web member were supplied to a heating roller. Then, the recording medium was subjected to a fixing treatment at a nip pressure of 0.25 MPa and a nip width of 4 mm by passing the recording medium between a pair of rollers (heating roller and pressure-applying roller) heated to 60° C. In this way, evaluation samples were obtained.

Meanwhile, the roller used as the heating roller (fixing roller) in FIG. 2 has an SUS-made cylindrical core having a halogen lamp built in, the surface of which was coated with a silicone resin.

Each of unprinted recording media as shown in Tables 1 and 2 cut into a size of 10 mm×50 mm was wound around a paperweight (with a weight of 470 g and a size of 15 mm×30 mm×120 mm) (the contact area of the unprinted recording medium and the evaluation sample was 150 $mm^2$), and the above-manufactured evaluation sample was rubbed with three times back and forth (equivalent to a load of 260 $kg/m^2$). After the rubbing, the printed surface was visually observed, and evaluation was conducted according to the evaluation criteria below.

<Evaluation Criteria>

A: No erasing of the image on the printed surface is visually observed.

B: A little erasing of the image on the printed surface is visually observed, which is practically non-problematic.

C: Erasing of the image on the printed surface is visually observed, which is practically problematic.

—Blocking Evaluation—

A solid image was manufactured in the same manner as for the scratch resistance. Two pieces of the evaluation sample were cut into a size of 4 cm×4 cm, and were attached together such that the recorded surfaces face each other and, thereto, a pressure of 2.0 MPa was applied for 30 seconds by a press machine. Thereafter, the attached two pieces of evaluation sample were separated (peeled off). How easily the two pieces of the evaluation sample were peeled off and whether there was a color transfer after the peeling-off was visually observed, and evaluation was conducted according to the evaluation criteria below.

<Evaluation Criteria>

A: The two pieces are peeled-off naturally, and no color transfer between the two pieces of paper is observed.

B: Sticking occurs, and color transfer between the two pieces of paper is somewhat observed.

C: Practically problematic. Sticking is strong, and color transferred between the two pieces of paper is observed.

—Offset to Heating Roller—

Printing was conducted in the same manner as the scratch resistance evaluation except that an ink droplet amount was changed to 7.0 pL in the formation of the solid image, and the temperatures of the heating roller and the pressure-applying roller were made to be 70° C. Peeling-off of the image portion due to the transfer of images to the heating roller was visually observed, and evaluation was conducted according to the evaluation criteria below.

<Evaluation Criteria>

A: No peeling-off of the image on the printed surface is visually observed.

B: A little peeling-off of the image on the printed surface is visually observed, which is practically non-problematic.

C: Peeling-off of the image on the printed surface is visually observed, which is practically problematic.

TABLE 1

| | Web Member | | | Evaluation | | |
|---|---|---|---|---|---|---|
| | Web member | Powder particles | Particle diameter (μm) | Scratch resistance | Block-ing | Offset |
| Example 1 | Web member 1 | PMMA | 10 | A | A | A |
| Example 2 | Web member 2 | PMMA | 6 | A | A | A |
| Example 3 | Web member 3 | PMMA | 15 | A | A | A |
| Example 4 | Web member 4 | Silica | 10 | A | A | A |
| Comparative example 1 | Web member 5 | None | — | C | C | C |
| Comparative example 2 | Web member 6 | PMMA | 0.8 | B | C | C |

TABLE 2

| | Web Member | | | Recording Medium | | Evaluation | | |
|---|---|---|---|---|---|---|---|---|
| | Web member | Powder particles | Particle diameter (μm) | Type of Paper | Basis weight ($g/m^2$) | Scratch resistance | Blocking | Offset |
| Example 5 | Web member 11 | PMMA | 8 | TOPKOTE PLUS | 127 | A | A | A |
| Example 6 | Web member 11 | PMMA | 8 | TOPKOTE PLUS | 157 | A | B | A |
| Example 7 | Web member 11 | PMMA | 8 | AIBESUTO | 310 | A | B | B |
| Example 8 | Web member 12 | Polystyrene | 16 | TOPKOTE PLUS | 127 | A | A | A |
| Example 9 | Web member 12 | Polystyrene | 16 | TOPKOTE PLUS | 157 | A | A | A |
| Example 10 | Web member 12 | Polystyrene | 16 | AIBESUTO | 310 | A | A | A |
| Example 11 | Web member 13 | PMMA | 20 | TOPKOTE PLUS | 127 | A | A | A |
| Example 12 | Web member 13 | PMMA | 20 | TOPKOTE PLUS | 157 | A | A | A |
| Example 13 | Web member 13 | PMMA | 20 | AIBESUTO | 310 | A | A | A |
| Example 14 | Web member 14 | PMMA | 30 | TOPKOTE PLUS | 127 | A | A | A |
| Example 15 | Web member 14 | PMMA | 30 | TOPKOTE PLUS | 157 | A | A | A |
| Example 16 | Web member 14 | PMMA | 30 | AIBESUTO | 310 | A | B | A |
| Example 17 | Web member 15 | PMMA | 40 | TOPKOTE PLUS | 127 | A | B | A |

TABLE 2-continued

| | Web Member | | | Recording Medium | | Evaluation | | |
|---|---|---|---|---|---|---|---|---|
| | Web member | Powder particles | Particle diameter (μm) | Type of Paper | Basis weight ($g/m^2$) | Scratch resistance | Blocking | Offset |
| Example 18 | Web member 15 | PMMA | 40 | TOPKOTE PLUS | 157 | A | B | A |
| Example 19 | Web member 15 | PMMA | 40 | AIBESUTO | 310 | A | B | B |
| Comparative Example 3 | Web member 16 | PMMA | 0.6 | TOPKOTE PLUS | 127 | B | C | C |
| Comparative Example 4 | Web member 16 | PMMA | 0.6 | TOPKOTE PLUS | 157 | B | C | C |
| Comparative Example 5 | Web member 16 | PMMA | 0.6 | AIBESUTO | 310 | B | C | C |

TOPKOTE PLUS (trade name), manufactured by Oji Paper Co., Ltd.
AIBESITO (trade name), manufactured by Nippon Daishowa Paperboard Co., Ltd.

If an inkjet printed article is manufactured by the image forming method according to the present invention, since a liquid including the powder particles are firstly supplied to a heating roller and then applied to a recording medium, it is possible to suppress scattering of the powder particles into the air and clogging of an inkjet nozzle caused by the scattering of the powder particles into the air. In addition, as is clear from the results in Tables 1 and 2, it can be understood that blocking can also be suppressed and scratch resistance is also good. Furthermore, it can be also understood that the image forming method according to the present invention can effectively prevent the peeling-off of recorded images (suppression of fixing offset) in the moment of the transfer of the powder particles by the heating roller.

According to the present invention, it is possible to suppress the blocking of printed articles while clogging of an inkjet nozzle is also suppressed, when recording images on a recording medium by an inkjet method. In addition, it is also possible to improve scratch resistance.

Exemplary embodiments of the invention include, but are not limited to, the following.

<1> An inkjet image forming method comprising:

recording an image on a recording medium by an inkjet method;

supplying a liquid comprising powder particles having a volume-average particle diameter of 1 μm or more to a surface of a heating roller; and applying the powder particles onto the recording medium via the heating roller.

<2> The inkjet image forming method according to <1>, wherein the powder particles are supplied to the heating roller by bringing a fabric material, into which the liquid has been impregnated, into contact with the surface of the heating roller, and the powder particles are applied onto the recording medium via the heating roller.

<3> The inkjet image forming method according to <1> or <2>, wherein the liquid is supplied to the surface of the heating roller, and the heating roller is pressed onto the recording medium.

<4> The inkjet image forming method according to <3>, wherein the liquid is supplied to the surface of the heating roller, and the recording medium passes between the heating roller and a pressure-applying roller.

<5> The inkjet image forming method according to any one of <1> to <4>, wherein the powder particles are applied to the recording medium in such a manner that the powder particles are not crushed.

<6> The inkjet image forming method according to any one of <1> to <5>, wherein the liquid comprises a non-volatile solvent.

<7> The inkjet image forming method according to <6>, wherein the non-volatile solvent is a silicone oil or a fluorine-containing oil.

<8> The inkjet image forming method according to any one of <1> to <7>, wherein the powder particles are water-insoluble.

<9> The inkjet image forming method according to <8>, wherein the power particles are selected from the group consisting of poly(methyl acrylate) particles, poly(methyl methacrylate) particles, silica particles and mixtures thereof <10> The inkjet image forming method according to any one of <3> to <9>, wherein the heating roller is pressed onto the surface of the recording medium with a pressure in a range of from 0.1 MPa to 3.0 MPa.

All publications, patent applications, and technical standards mentioned in this specification are herein incorporated by reference to the same extent as if each individual publication, patent application, or technical standard was specifically and individually indicated to be incorporated by reference.

What is claimed is:

1. An inkjet image forming method comprising:

recording an image on a recording medium by an inkjet method;

supplying a liquid comprising powder particles having a volume-average particle diameter of 1 μm or more to a surface of a heating roller; and applying the powder particles onto the recording medium via the heating roller; wherein the powder particles are supplied to the heating roller by bringing a fabric material, into which the liquid has been impregnated, into contact with the surface of the heating roller, and the powder particles are applied onto the recording medium via the heating roller.

2. The inkjet image forming method according to claim 1, wherein the liquid is supplied to the surface of the heating roller, and the heating roller is pressed onto the recording medium.

3. The inkjet image forming method according to claim 2, wherein the liquid is supplied to the surface of the heating roller, and the recording medium passes between the heating roller and a pressure-applying roller.

4. The inkjet image forming method according to claim 2, wherein the heating roller is pressed onto the surface of the recording medium with a pressure in a range of from 0.1 MPa to 3.0 MPa.

5. The inkjet image forming method according to claim 1, wherein the powder particles are applied to the recording medium in such a manner that the powder particles are not crushed.

6. The inkjet image forming method according to claim 1, wherein the liquid comprises a non-volatile solvent.

7. The inkjet image forming method according to claim 6, wherein the non-volatile solvent is a silicone oil or a fluorine-containing oil.

8. The inkjet image forming method according to claim 1, wherein the powder particles are water-insoluble.

9. The inkjet image forming method according to claim 8, wherein the power particles are selected from the group consisting of poly(methyl acrylate) particles, poly(methyl methacrylate) particles, silica particles and mixtures thereof.

* * * * *